US006642816B2

(12) United States Patent
Tsujiguchi et al.

(10) Patent No.: US 6,642,816 B2
(45) Date of Patent: Nov. 4, 2003

(54) STRIP-LINE FILTER, DUPLEXER, FILTER DEVICE, COMMUNICATION DEVICE, AND METHOD OF ADJUSTING CHARACTERISTIC OF STRIP-LINE FILTER

(75) Inventors: Tatsuya Tsujiguchi, Kanazawa (JP); Shigeji Arakawa, Kanazawa (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 10/251,476

(22) Filed: Sep. 18, 2002

(65) Prior Publication Data

US 2003/0085781 A1 May 8, 2003

Related U.S. Application Data

(62) Division of application No. 09/711,837, filed on Nov. 13, 2000.

(30) Foreign Application Priority Data

Nov. 12, 1999 (JP) ..... 11-323348
Sep. 14, 2000 (JP) ..... 2000-280415

(51) Int. Cl.[7] ..... H01P 3/08
(52) U.S. Cl. ..... 333/204; 333/134; 333/205

(58) Field of Search ..... 333/204, 134, 333/205, 203

(56) References Cited

U.S. PATENT DOCUMENTS 3,451,015 A * 6/1969 Heath ..... 333/203
6,178,339 B1 * 1/2001 Sakai et al. ..... 505/210

* cited by examiner

*Primary Examiner*—Robert Pascal
*Assistant Examiner*—Joseph Chang
(74) *Attorney, Agent, or Firm*—Ostrolenk, Faber, Gerb & Soffen, LLP

(57) ABSTRACT

Resonator electrodes are provided on the upper face of a dielectric substrate. The ratios (W1/L1) and (W3/L3) of the electrode widths W1 and W3 to the electrode lengths L1 and L3 of the resonator electrodes of the first and last stages are set at substantially 1.05<W/L<1.95. Lead-out electrodes are connected to the resonator electrodes of the first and last stages on the opposite sides of the center axis which is a straight-line axis passing through the center positions of the resonator electrodes of the first and last stages. Thereby, an attenuation pole is generated on the lower band side of the pass-band.

23 Claims, 7 Drawing Sheets

STRIP-LINE FILTER, DUPLEXER, FILTER DEVICE, COMMUNICATION DEVICE, AND METHOD OF ADJUSTING CHARACTERISTIC OF STRIP-LINE FILTER

CROSS REFERENCE TO RELATED APPLICATIONS

This is a division of U.S. patent application Ser. No. 09/711,837, filed Nov. 13, 2000 in the name of Tatsuya TSUJIGUCHI and Shigeji ARAKAWA, entitled STRIP-LINE FILTER, DUPLEXER, FILTER DEVICE, COMMUNICATION DEVICE, AND METHOD OF ADJUSTING CHARACTERISTIC OF STRIP-LINE FILTER.

BACKGROUND OF THE INVENTION

1. Field of the Invention

The present invention relates to a strip-line filter for use in a microwave band and an extremely high frequency band, a duplexer, a filter device, a communication device, each including the strip-line filter, and a method of adjusting a characteristic of the strip-line filter.

2. Description of the Related Art

Conventional strip-line filters are disclosed in Japanese Unexamined Patent Application Publication No. 56-116302, U.S. Pat. No. 3,451,015, and Japanese Examined Patent Application Publication No. 62-19081 (U.S. Pat. No. 4,352,076).

In Japanese Unexamined Patent Application Publication No. 56-116302, plural resonator electrodes each constituting half-wave resonators are arranged substantially in parallel to each other on a substrate, and lead-out electrodes are connected to the resonator electrodes of the first and last stages.

U.S. Pat. No. 3,451,015 discloses a strip-line filter in which plural resonator electrodes each constituting half-wave resonators or quarter-wave resonators are arranged substantially in parallel to each other on a substrate, and lead-out electrodes are connected to the resonator electrodes of the first and last stages.

In Japanese Examined Patent Application Publication No. 62-19081 (U.S. Pat. No. 4,352,076), a strip-line filter is disclosed in which plural resonator electrodes each constituting a half-wave resonator are arranged substantially in parallel to each other on a substrate, and a coupling conductor forms a static capacitance with the resonator electrodes for coupling the resonator electrodes with an opposite phase so that an attenuation pole is developed.

In the case of a strip-line filter in which an attenuation pole is developed by coupling the resonator electrodes with opposite phase, as described in the above-mentioned Japanese Examined Patent Application Publication No. 62-19081, the band-pass filter can be provided with a steep attenuation characteristic in the range between the transmission band and the attenuation band.

Japanese Unexamined Patent Application Publication No. 56-116302 and U.S. Pat. No. 3,451,015 do not describe such strip-line filters having such attenuation poles developed therein.

A disadvantage of the above strip-line filter, having coupling with opposite phase between the input and output stages through a static capacitance, is that the transmission characteristic of the pass band is unnecessarily reduced, since attenuation poles are produced on both the higher and lower sides of the pass-band. That is, the insertion loss generated in the pass band may be increased, or the pass band width may become too narrow.

Furthermore, the static capacitances between the electrode patterns are somewhat unpredictable, due to variations in the sizes of the electrode patterns. It may be difficult to obtain stable attenuation poles.

SUMMARY OF THE INVENTION

Accordingly, the present invention provides a strip-line filter in which a stable attenuation pole is generated on one side, that is, on the lower or higher side of the pass-band, without the input and output being coupled by means of a static capacitance. Thus, the above-described problems are solved.

The invention further provides a duplexer, a filter device, a communication device including the filter, and a method of adjusting the filter characteristic of the strip-line filter.

To provide these advantages, a first aspect of the present invention provides a strip-line filter which comprises plural resonator electrodes each constituting a half-wave resonator arranged in one direction on or inside of a substrate, and lead-out electrodes connected to the resonator electrodes of the first and last stages, at least one of the resonator electrodes of the first and last stages having a ratio (W/L) of an electrode width W to an electrode length L in the range of about $1.05<W/L<1.95$, in which the electrode length L is an electrode length of the resonator electrode measured perpendicular to the direction in which the resonator electrodes are arranged, and the electrode width W is an electrode width of the resonator electrode measured parallel to the arrangement direction. Further, the lead-out electrodes are connected to the resonator electrodes of the first and last stages on opposite sides of the center axis, which is a straight line axis passing in said arrangement direction through the center positions along said length direction of the resonator electrodes of the first and last stages.

As seen in the concrete examples, namely, the embodiments described below, experiments by the inventors have revealed that the above-described configuration causes an attenuation pole to develop on the lower side of the pass-band. In the present invention, the attenuation characteristic is steeply changed in the range from the pass-band to the attenuation band on the lower side. Furthermore, no attenuation pole is generated on the higher band side of the pass-band, and the transmission characteristic in the pass-band is not deteriorated.

Furthermore, according to a second aspect of the present invention, there is provided another strip-line filter which comprises plural resonator electrodes each constituting half-wave resonators arranged in one direction on or inside of a substrate, and lead-out electrodes connected to the resonator electrodes of the first and last stages, at least one of the resonator electrodes of the first and last stages having a ratio (W/L) of an electrode width W to an electrode length L in the range of about $0.10<W/L<0.95$. Further, lead-out electrodes are connected to the resonator electrodes of the first and last stages on the same side of the center axis.

As seen in the concrete examples, namely, the disclosed embodiments, experiments by the inventors have revealed that the above-described configuration causes an attenuation pole to develop on the higher side of the pass-band. In the present invention, the attenuation characteristic changes steeply in the range from the pass-band to the attenuation band on the higher side. Furthermore, no attenuation poles are generated on the lower side of the pass-band, and the transmission characteristic in the pass-band is not deteriorated.

Preferably, the lead-out electrodes each are led-out from the strip-line filter substantially at the ends of the center axis, and function as input-output terminals. Thereby, the substrate having the filter configured thereon and electrodes provided on a circuit board or package for mounting the substrate can be connected more effectively.

A duplexer in accordance with the present invention comprises two of the above-described strip-line filters. Thereby, a duplexer with increased attenuation in a required frequency band is provided.

Preferably, the duplexer comprises one strip-line filter of one of the above two types and one strip-line filter of the other type. Thereby, in the case in which one filter constitutes a transmission filter, and the other filter constitutes a reception filter, the attenuation characteristic changes steeply at the boundary between the adjacent transmission and reception bands, so as to suppress leakage of a transmission signal to the reception circuit.

A filter device in accordance with the present invention is formed by mounting the above-described strip-line filter or duplexer to a cover, a casing, or a waveguide having a cut-off frequency which exerts no influence over the filter characteristic.

Furthermore, in a communication device in accordance with the present invention, the above-described strip-line filter or duplexer is disposed, e.g., in a filter section or an antenna sharing device section for carrying a transmission or reception signal in a high frequency circuit.

According to the present invention, there is provided a method of adjusting the filter characteristic of a strip-line filter which comprises the steps of providing a frequency adjustment electrode protruding from at least one of the resonator electrodes, preferably perpendicularly to the arrangement direction of the resonator electrodes in the above-described strip-line filter, and removing a predetermined amount of the frequency adjustment electrode to adjust the center frequency of the filter. The frequency adjustment electrode may be advantageously included in each of the disclosed embodiments of the invention.

Moreover, there is provided another method of adjusting the characteristic of a strip-line filter which comprises the step of providing an external coupling adjustment electrode protruding from at least one of the lead-out electrodes, preferably perpendicularly to the arrangement direction of the resonator electrodes, and removing a predetermined amount of the external coupling adjustment electrode to adjust the external coupling of the filter. The external coupling adjustment electrode may be advantageously included in each of the disclosed embodiments of the invention.

Other features and advantages of the present invention will become apparent from the following description of the invention which refers to the accompanying drawings, in which like references denote like elements and parts.

DESCRIPTION OF EMBODIMENTS OF THE INVENTION

The configuration of a strip-line filter according to a first embodiment will be described with reference to FIGS. 1 to 3.

Figure 1:
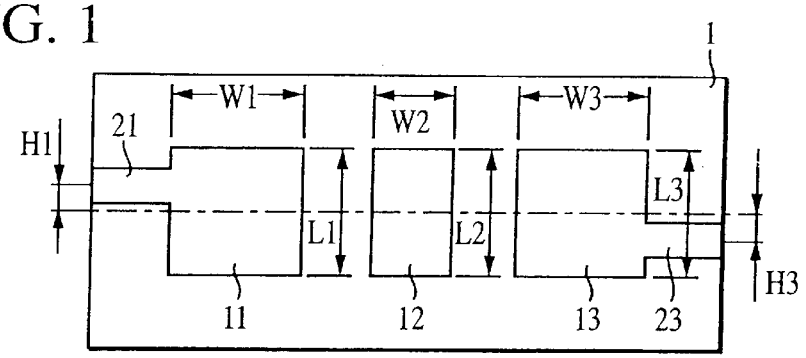
FIG. 1 is a plan view of the major part of a strip-line filter according to a first embodiment of the present invention.

FIG. 1 is a plan view showing the major part of the strip-line filter. On the upper face of a dielectric substrate 1, three resonator electrodes 11, 12, and 13 are arranged in one direction, and lead-out electrodes 21 and 23 are formed so as to extend from the resonator electrodes of the first and last stages. The electrode lengths L1, L2, and L3 of the resonator electrodes 11, 12, and 13 are electrode lengths measured perpendicular to the arrangement direction (that is, the center axial direction) of the resonator electrodes, and the electrode widths W1, W2, and W3 of the resonator electrodes 11, 12, and 13 are electrode widths measured parallel to the arrangement direction. These resonator electrodes 11, 12, and 13 function as strip-line resonators for half-wave resonance in respective predetermined operating frequency bands. In addition, the resonator electrodes 11, 12, and 13 are arranged in such a manner that the centers of the electrode lengths of the respective resonator electrodes are arranged substantially in a straight line along the arrangement direction, as indicated by the long and short dash line in FIG. 1. The long and short dash line is the center axis of the resonator electrodes in the arrangement direction.

The resonator electrode 11 is provided with a lead-out electrode 21. The lead-out electrode 21 is connected thereto on the upper side, as viewed in FIG. 1, of the center axis of the resonator electrodes 11, 12, and 13 in the arrangement direction and its center is at a distance H1 from the center axis. That is, in the electrode pattern, the lead-out electrode 21 is extended from a predetermined position of the resonator electrode 11.

The resonator electrode 13 is provided with a lead-out electrode 23. The lead-out electrode 23 is connected thereto on the lower side, as viewed in FIG. 1, of the center axis of the resonator electrodes 11, 12, and 13 in the arrangement direction and its center is spaced a distance H3 from the center axis. That is, the lead-out electrode 23 is connected thereto on the side of the center axis which is opposite to the connection point of the lead-out electrode 21 connected to the resonator electrode of the first stage. The lead-out electrodes 21 and 23 are led out onto the opposite end-faces of the dielectric substrate 1, and function as input-output terminals. A ground electrode is formed substantially on the whole of the under face of the dielectric substrate 1.

The above-described resonator electrodes 11, 12, and 13, and the lead-out electrodes 21 and 23 can be simultaneously formed on the surface of the dielectric substrate 1 by thick film printing process or patterning a thin film conductor film.

The resonator electrode 11 of the first stage and the resonator electrode 13 of the last stage each have a ratio (W/L) of the electrode length L to the electrode width W of more than about 1.05, respectively. That is, in this embodiment, the resonators have a relation of W1/L1>1.05 and W3/L3>1.05.

The dielectric substrate 1 having the electrode pattern shown in FIG. 1 formed thereon is mounted onto a waveguide or a metal case, or mounted into a ceramic package having a metal cover and a ground conductor, each having such a cut-off frequency as exerts no influence over the filter characteristic, whereby a filter part is formed which can be mounted onto a circuit board in a communication device.

As described above, the filter of this embodiment is a strip-line filter comprising plural electrodes each constituting a half-wave resonator and arranged in one direction on a dielectric substrate, and lead-out electrodes connected to the resonator electrodes of the first and last stages. In this case, the inventors have experimentally found that when the electrode lengths L1, L2, and L3 of the respective resonator electrodes 11, 12, and 13 are set so that the center frequency of the pass-band for a signal in the filter lies in a desired operating frequency band, the ratio (W/L) of the electrode length L to the electrode width W is set at about 1, and the lead-out electrodes are connected to the resonator electrodes of the first and last stages, a particular attenuation pole is produced. It is believed that this is caused as follows. When the electrode length and the electrode width of each of the resonator electrodes of the first and last stages are nearly equal to each other, a resonance mode in the direction orthogonal to the dominant resonance mode of the resonator electrodes 11 and 13, that is, a secondary resonance mode having a resonator length equal to the width W and an electrode width equal to the length L is developed. When the resonance frequency in the above secondary resonance mode approaches the resonance frequency in the dominant resonance mode, the secondary resonance mode couples to the dominant resonance mode, so that a pole is produced in the pass band.

Figure 2:
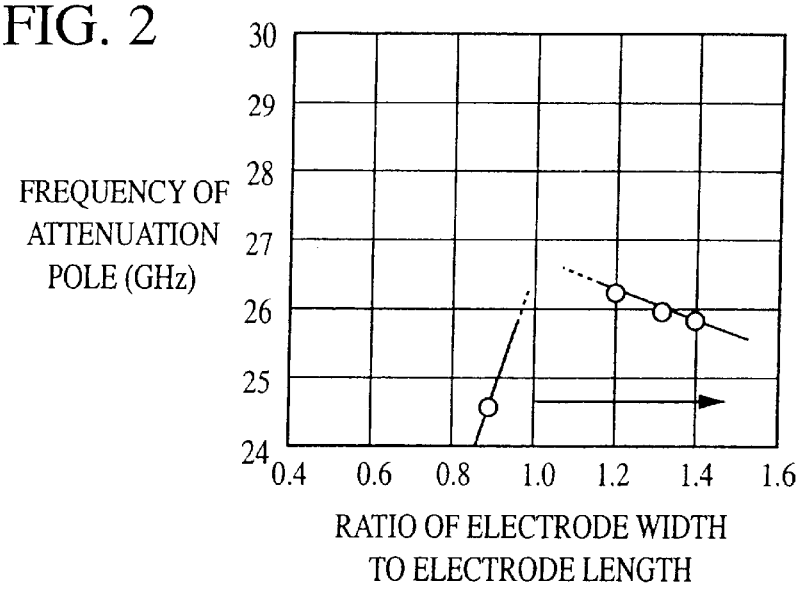
FIG. 2 is a graph showing the relation between the electrode width and electrode length of the filter and the attenuation pole frequency.

FIG. 2 shows the relation between the electrode length L and the electrode width W of the resonator electrode 11 and 13 of the first and third stages, and the attenuation pole frequency.

In this case, the electrode lengths L1, L2, and L3 of the respective resonator electrodes 11, 12, and 13 are set so that the center frequency of the pass-band is included in the operating frequency band (27 (GHz)), and the ratio (W/L) of the electrode width W to the electrode length L is varied.

As seen in FIG. 2, whenever W/L is in the vicinity of 1.0, an attenuation pole is produced on the lower band side of the pass-band (27 (GHz)). It is presumed that the attenuation pole on the lower band side of the pass-band is caused by effects of the above-described secondary resonance mode, depending on the connection positions of the lead-out electrodes with respect to the resonator electrodes of the first and last stages. Under the condition of W/L of less than 1, with W/L being decreased, the attenuation pole appears more distant from the pass-band. Furthermore, when W/L becomes approximately 1, the attenuation pole frequency approaches the pass band and exerts a great influence over the reflection characteristic of the pass-band. Accordingly, by setting W/L at a value greater than 1, the attenuation pole developed on the lower band side of the pass-band can be effectively utilized.

When W/L is about 1.05 or less, the attenuation pole is produced in the pass band. Accordingly, this value of W/L is unsuitable for attaining an ordinary band-pass characteristic. When the W/L exceeds 1 and becomes near to 2 (concretely, $1.95 \leqq W/L < 2$), an attenuation pole on the higher band side, caused by the second harmonic in the above-described secondary resonance mode, becomes near to the pass-band to exert a great influence on the reflection characteristic with respect to the pass-band. Furthermore, in the range of W/L>2.05, an attenuation pole is produced in the lower band, similarly to the case of 1.05<W/L<1.95. However, this is unfavorable for reduction of the filter size. Therefore, it is required to set the W/L in the range of about 1.05<W/L<1.95. The above-described relation is shown in the following table.

TABLE 1

| ratio W/L | 1.05 < W/L < 1.95 | 1.95 ≦ W/L < 2 | 2 < W/L < 2.05 | 2.05 < W/L |
|---|---|---|---|---|
| position of attenuation pole | an attenuation pole is developed in the lower band, due to the first harmonic in a secondary resonance mode. | an attenuation pole is developed in the higher band, due to the second harmonic in a secondary resonance mode near to the pass-band. | an attenuation pole is generated in the lower band, due to the second harmonic in a secondary resonance mode near to the pass-band. | an attenuation pole is generated in the lower band, due to the second harmonic in a secondary resonance mode. |
| uses, etc. | a small size and good characteristic can be obtained. | causes effects on reflection characteristic in the pass-band. | causes effects on reflection characteristic in the pass-band. | Good characteristic can be obtained, but the range of the ratio is unfavorable for miniaturization. |

When the thickness of the dielectric substrate 1 shown in FIG. 1 is 0.25 mm, the dielectric constant is 39, and the sizes of the respective parts of the substrate 1 are set as follows:

W1=0.96 mm, L1=0.80 mm

W2=0.60 mm, L2=0.84 mm

Figure 3:
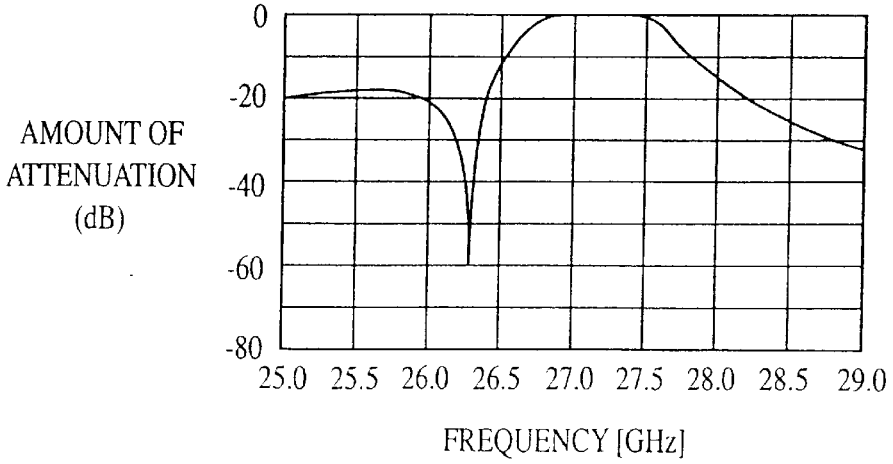
FIG. 3 is a graph showing the attenuation characteristic of the filter.

W3=0.96 mm, L3=0.80 mm, the obtained attenuation characteristic of the above-described strip-line filter is shown in FIG. 3. As seen in the figure, the attenuation pole is produced only on the lower band side of the pass-band. Therefore, there arise no problems such as unnecessary attenuation produced in the pass band and narrowing of the pass-band. Moreover, the effect of variations in the sizes of the electrode patterns on the filter characteristic are reduced, since the relation between the attenuation pole frequency and the center frequency in the pass band is determined by the ratio of W to L.

Figure 4:
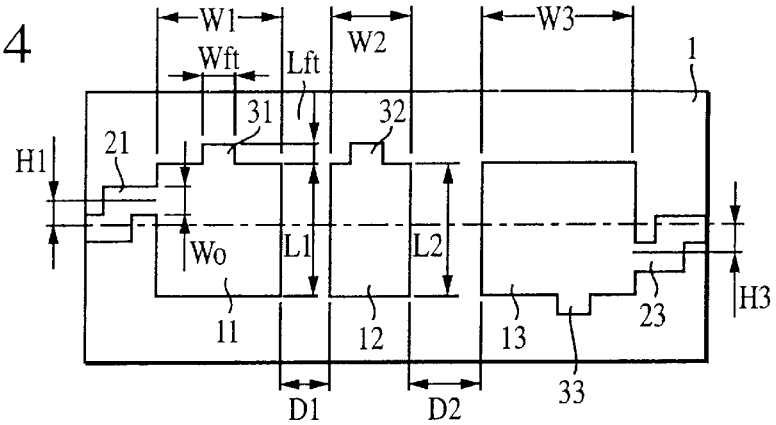
FIG. 4 is a plan view showing the major part of a strip-line filter according to a second embodiment of the present invention.

FIG. 4 is a plan view of the major part of a strip-line filter according to a second embodiment. In the example shown in FIG. 1, the electrode length and width of the resonator electrode of the first stage are equal to those of the last stage, and moreover, the resonator electrodes of the three stages are arranged in a symmetrical configuration. However, the sizes of these parts may also be different from each other. That is, the electrode lengths of the resonator electrodes may be differently set. Intervals D1 and D2 between the resonator electrodes, which determine coupling between the resonators, may be appropriately set, depending on the design thereof. In the example shown in FIG. 4, the electrode width W1 of the resonator electrode 11 of the first stage is different from the electrode width W3 of the resonator electrode of the last stage, resulting in different intervals D1 and D2 between the resonator electrodes.

The connection positions (lead-out positions) of the lead-out electrodes connected to the resonator electrodes of the first and last stages may be set so as to be on the opposite sides of the center axis indicated by the long and short dash line in FIG. 4. However, the turning-patterns of the lead-out electrodes may optionally be modified. Thus, in this embodiment as in the other embodiments, the lead-out electrodes 21 and 23 may be turned along the center axis of the dielectric substrate 1 for use as input-output terminals, as shown in FIG. 4. Thus, the lead-out electrodes are led-out substantially at the centers of the ends of the substrate. Thus, the lead-out electrodes are arranged in a straight line. Accordingly, electrodes provided for a circuit board or package to which this substrate is mounted can be easily connected to the lead-out electrodes on the substrate by means of gold wires or gold ribbons. Furthermore, the positions of electrodes provided on a circuit board or package to which this substrate is mounted can be standardized, irrespective of the types of substrates. Thus, the number of necessary types of circuit boards or packages can be reduced to a minimum.

Furthermore, it is unnecessary to lead out the lead-out electrodes correctly to the center in width of the substrate. If the width of the respective lead-out electrodes ranges so as to include the center line in the widthwise direction of the substrate, the above-described advantages can be obtained.

Figure 5:
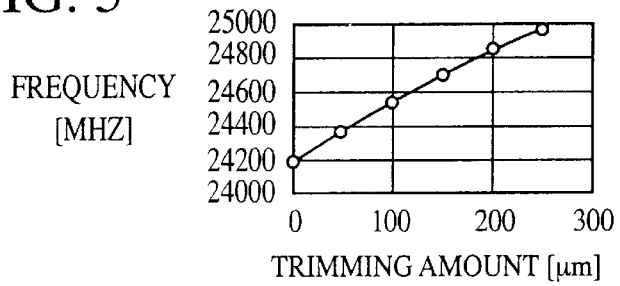
FIG. 5 is a graph showing the relation between the trimming amount of a frequency adjustment electrode of the strip-line filter and change in frequency.

In FIG. 4, frequency adjustment electrodes 31, 32, and 33 protrude from the resonator electrodes 11, 12, and 13 perpendicularly to the arrangement direction thereof. The center resonance frequency of the resonator electrodes of the respective stages can be adjusted by removing the necessary amount of these parts by laser trimming or the like. The width of the frequency adjustment electrode 31 and the protuberant amount are designated by Wft and Lft, respectively. The Lft is trimmed in the range of 0 to 250 $\mu$m. FIG. 5 shows the relation between the trimming amount and the resonance frequency of the resonator caused by the resonator electrode 11. The substrate of the strip-line filter is an alumina sheet having a dielectric constant $\epsilon r$ of 9.6 and a thickness of 0.254 mm, and has W1=400 $\mu$m, L1=2020 $\mu$m, H1=250 $\mu$m, Wo=70 $\mu$m, and Wft=50 $\mu$m.

For the trimming amount in FIG. 5, the initial value is zero at Lft=250 $\mu$m. That is, the resonance frequency before trimming is 24.2 [GHz], and that after trimming in an amount of 250 $\mu$m is 24.95 [GHz].

As seen in FIG. 5, by trimming the frequency adjustment electrode in a predetermined amount, the resonance frequency of the filter of this embodiment can be adjusted to a desired value.

Next, the configuration of a strip-line filter according to a third embodiment will be described with reference with FIGS. 6 and 7.

Figure 6:
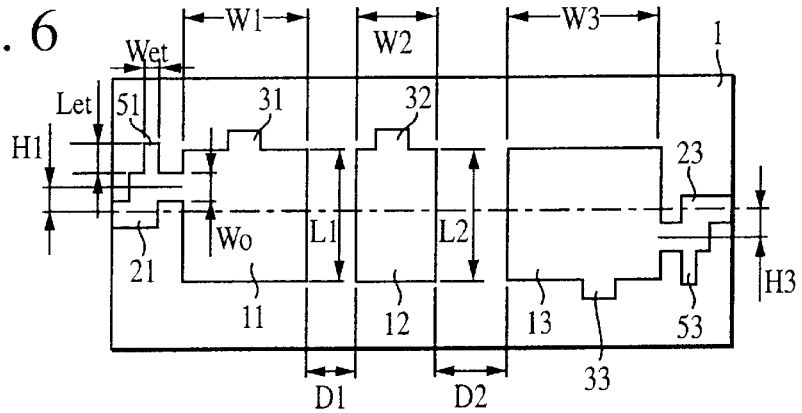
FIG. 6 is a plan view of the major part of a strip-line filter according to a third embodiment of the present invention.

FIG. 6 is a plan view of the major part of the strip-line filter. External coupling adjustment electrodes 51 and 53 are provided, in addition to or instead of the electrodes 31, 32 and 33, differently from the example shown in FIG. 4. The rest of the configuration is similar to that shown in FIG. 4.

Figure 7:
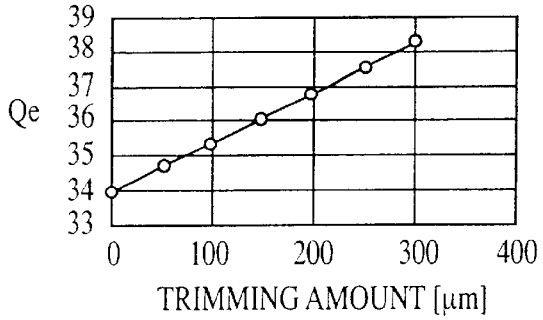
FIG. 7 is a graph showing the relation between the trimming amount of an external coupling adjustment electrode of the strip-line filter and change in external Q.

In FIG. 7, the width of the external coupling adjustment electrode 51 and the protuberant amount are designated by Wet and Let. The Let is trimmed in the range of 0 to 300 $\mu$m. FIG. 7 shows the relation between the trimming amount and the external Q (Qe). The substrate of the strip-line filter is an alumina sheet having a dielectric constant $\epsilon r$ of 9.6 and a thickness of 0.254 mm, and has W1=400 $\mu$m, L1=2020 $\mu$m, H1=250 $\mu$m, Wo=70 $\mu$m, and Wet=50 $\mu$m. For the trimming amount shown in FIG. 7, the initial value is zero at Let=300 $\mu$m. That is, the Qe before trimming is about 34. The Qe after trimming by about 300 $\mu$m is about 38.

As seen in FIG. 7, the external coupling of the filter of this embodiment, and especially the Qe, can be adjusted to a desired value by trimming the frequency adjustment electrode in a predetermined amount. That is, impedance matching to other circuits can be easily performed.

Next, the configuration of a strip-line filter according to a fourth embodiment will be described with reference with FIGS. 8 to 10.

Figure 8:
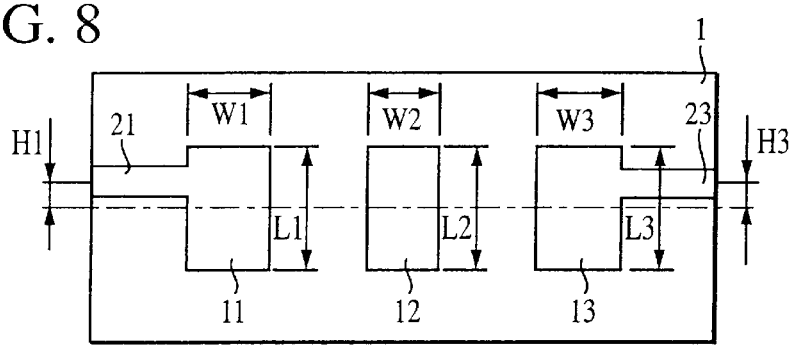
FIG. 8 is a plan view of the major part of a strip-line filter according to a fourth embodiment of the present invention.

FIG. 8 is a plan view of the major part of the strip-line filter. On the upper face of a dielectric substrate 1, three resonator electrodes 11, 12, and 13 are arranged in one direction, and lead-out electrodes 21 and 23 are formed so as to extend from the resonator electrodes 11 and 13 of the first and second stages, similarly to the first embodiment shown in FIG. 1. The electrode lengths L1, L2, and L3 of the resonator electrodes 11, 12, and 13 are measured perpendicular to the arrangement direction (that is, the center axial direction) of the resonator electrodes, and the electrode widths W1, W2, and W3 of the resonator electrodes 11, 12, and 13 are measured parallel to the arrangement direction. These resonator electrodes 11, 12, and 13 act as strip-line resonators for half-wave resonance in predetermined operating frequency bands, respectively. These resonator electrodes 11, 12, and 13 are arranged so that the centers of the respective resonator electrodes are arranged substantially in a straight line along the arrangement direction (center axis) indicated by the long and short dash line in FIG. 8.

The resonator electrode 11 is provided with a lead-out electrode 21. The lead-out electrode 21 is connected thereto on the upper side, as viewed in FIG. 8, of the center axis of the resonator electrodes 11, 12, and 13 in the arrangement direction and its center is at the position distant by H1 from the center axis. The resonator electrode 13 is provided with a lead-out electrode 23. The lead-out electrode 23 is connected thereto on the upper side, as viewed in FIG. 8, of the center axis and its center is at the position distant by H3 from the center axis. That is, the connection positions of the lead-out electrodes 21 and 23 connected to the resonator electrodes 11 and 13 of the first and last stage are on the same side of the center axis, in contrast to the example shown in FIG. 1. Moreover, a ground electrode is formed substantially on the whole of the under face of the dielectric substrate 1.

As regards the resonator electrode 11 of the first stage and the resonator electrode 13 of the last stage, the electrode length L and the electrode width W have a ratio (W/L) of less than about 0.95, that is, to have a relation of W1/L1<0.95 and W3/L3<0.95, respectively, in this embodiment.

Although not shown in FIG. 8, either or both of the frequency adjustment electrode and the external coupling adjustment electrode described in connection with the preceding embodiments may advantageously be included in this embodiment as well.

Figure 9:
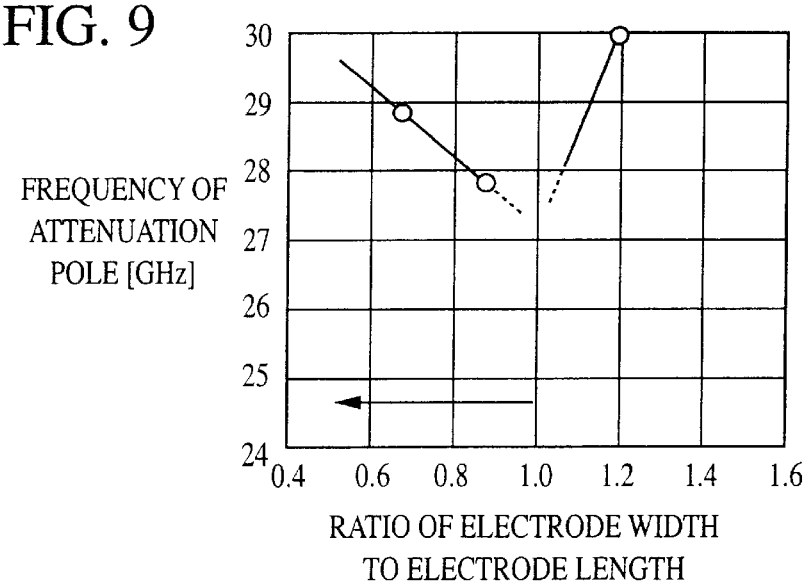
FIG. 9 is a graph showing the relation between the electrode width/electrode length of the filter and the attenuation pole frequency.

As seen in FIG. 9, in the strip-line filter comprising the plural resonator electrodes each constituting a half-wave resonator and arranged in one direction on the dielectric substrate, and the lead-out electrodes connected to the resonator electrodes of the first and last stages, the electrode lengths L1, L2, and L3 of the respective resonator electrodes 11, 12, and 13 are set so that the center frequency of the pass-band lies in a desired operating frequency band, the ratio (W/L) of the electrode length L to the electrode width W is set at about 1, and the lead-out electrodes are connected to the resonator electrodes of the first and last stages at the predetermined positions, respectively, whereby an attenuation pole is produced as described above.

FIG. 9 shows a relation between the electrode lengths L and the electrode widths W of the first stage resonator electrodes 11 and the last stage resonator electrodes 13 shown in FIG. 8 and the attenuation pole frequency.

In this case, the electrode lengths L1, L2, and L3 of the respective resonator electrodes 11, 12, and 13 are set, and the ratio (W/L) of the electrode length L to the electrode width W is changed so that the center frequency of the pass-band lies in an operating frequency band (27 (GHz)).

As shown in FIG. 9, in this example, whenever the above-described W/L is in the vicinity of 1.0, an attenuation pole is produced on the higher band side of the pass-band (27 (GHz) band). One of the reasons for this is believed to be that the connection positions of the lead-out electrodes connected to the resonator electrodes of the first and last stages are in an opposite relation to those shown in FIG. 1, so that the above-described secondary resonance mode exerts an influence oppositely to the case of FIG. 1, which causes the attenuation pole to develop on the higher band side of the pass-band. When W/L exceeds 1, then as W/L increases, the attenuation pole appears at a position more and more distant from the pass-band. Moreover, when the W/L becomes approximately 1, the attenuation pole frequency approaches the pass band to exert a great influence on the reflection characteristic with respect to the pass-band. Thus, the attenuation pole can be effectively utilized by setting the W/L at a value less than 1.

When the ratio W/L at which an attenuation pole is developed on the higher band side is 0.95 or higher, the attenuation pole is developed in the pass band. Accordingly, the ratio W/L is unsuitable for obtaining an ordinary band-transmission characteristic. Moreover, in the range of the W/L of up to 0.10, an attenuation pole is also developed on the higher band side. However, unless each electrode secures a predetermined width, the basic Q (Qo) is reduced. This will be described below.

Figure 11:
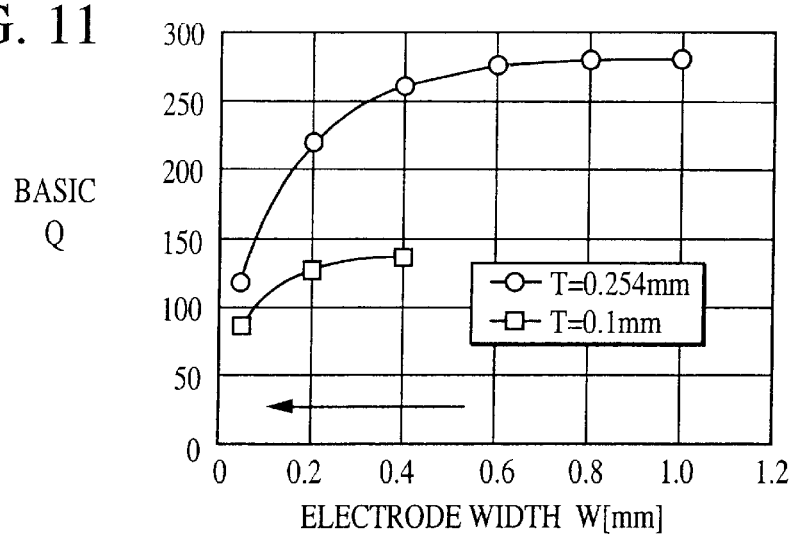
FIG. 11 is a graph showing the relation between the electrode width of the resonator electrode and the basic Q.

When a filter with a center frequency of 10 GHz is formed on a dielectric substrate having a dielectric constant of 20, the basic Q becomes higher with increasing electrode width, and becomes gradually saturated. FIG. 11 shows the relation of the Qo and the electrode width, determined by calculation. This result shows that the electrode width at which the Qo becomes equal to 90% of the saturation amount is about 1.6 times the thickness T of the substrate.

The thickness of a substrate which is generally used is 0.254 mm. In order to attain 90% of the saturation amount of the Qo as described above by use of the above substrate, the electrode width W needs to be at least 0.4 mm. Moreover, since the resonator electrode length L at 10 GHz is 4.01 mm, the ratio W/L becomes at least 0.10. That is, from the standpoint of the Qo, the condition of W/L>0.10 is required.

Accordingly, the W/L is set in the range of 0.10<W/L<0.95.

When the thickness of the dielectric substrate shown in FIG. 8 is 0.25 mm, the dielectric constant is 39, and the sizes of the respective parts are set as follows;

W1=0.60 mm, L1=0.865 mm,

W2=0.60 mm, L2=0.84 mm,

W3=0.60 mm, L3=0.865 mm

Figure 10:
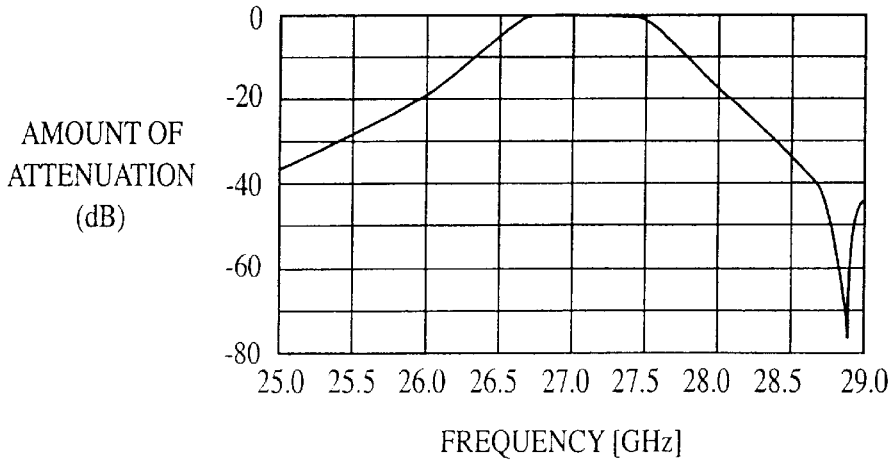
FIG. 10 is a graph showing the attenuation characteristic of the filter.

FIG. 10 shows the attenuation characteristic of the above-described strip-line filter. As seen in the figure, the attenuation pole is developed only on the higher band side of the pass-band. Accordingly, there arise no problems such as unnecessary attenuation in the pass-band, a narrow pass-band, and so forth. Furthermore, similarly to the case described above, the relation between the attenuation pole frequency and the center frequency is determined by the ratio of W to L. Accordingly, random variations in size of the electrode patterns exert less influence over the filter characteristic.

TABLE 2 shows the electrode lengths of the resonator electrodes, given when the dielectric constant of the substrate and the center frequency are varied.

TABLE 2

| | 9.5–20 | | 20–30 | | 30–40 | |
|---|---|---|---|---|---|---|
| εr<br>f | W/<br>L < 1 | W/<br>L > 1 | W/<br>L < 1 | W/<br>L > 1 | W/<br>L < 1 | W/<br>L > 1 |
| 10–20 GHz | 5796 | 1957 | 4007 | 1589 | 3296 | 1370 |
| 20–30 GHz | 2849 | 1277 | 1957 | 1033 | 1589 | 890 |
| 30–40 GHz | 1872 | 940 | 1277 | 760 | 1033 | 653 |

In TABLE 2, in the cases when W/L>1, the values represent the largest lengths of the resonators, and for W/L<1, the values represent the smallest lengths of the resonators, expressed in units of μm, respectively. Thus, more reduction in size can be enabled when a substrate having a higher dielectric constant is used. Moreover, by increasing the frequency, the size can be more reduced. It is necessary to select a substrate material, considering the dielectric loss, the electrode patterning accuracy, and so forth.

Figure 12:
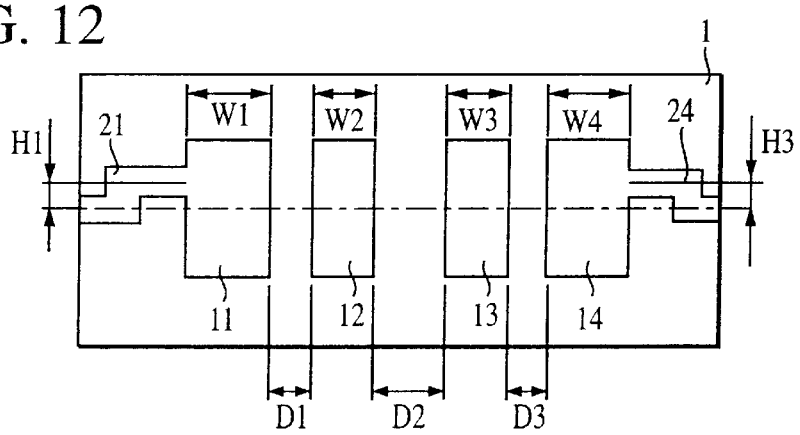
FIG. 12 is a plan view of the major part of a strip-line filter according to a fifth embodiment of the present invention.

FIG. 12 is a plan view of a strip-line filter according to a fifth embodiment. In the example shown in FIG. 8, the electrode length and the electrode width of the resonator electrode of the first stage are equal to those of the resonator electrode of the last stage, respectively, whereby resonator electrodes of three stages are arranged in a symmetrical configuration. Furthermore, as shown in FIG. 12, resonator electrodes may be arranged in four stages. The intervals D1, D2, and D3 between the resonator electrodes, which determine coupling between the resonator electrodes, may be appropriately set in conformation to design. More than three or four stages may be provided. In the example of FIG. 12, coupling between the first (initial) and second stages and that between the third and fourth (last) stages are set to be strong, respectively, and coupling between the second and third stages is set to be relatively weak so that a coupling coefficient determined according to a design theory for the filter is realized. Moreover, the connection positions (lead-out positions) of lead-out electrodes connected to the resonator electrodes of the first and last stages are set so as to be distant from the center axis in the same direction with respect to the center axis indicated by the long and short dash line in FIG. 12. Optionally, turning-patterns may be provided from the lead-out points. Thus, as shown in FIG. 12, the lead-out electrodes 21 and 23 may be formed so as to be turned along the center line of the dielectric substrate 1, or along the center lines of the respective resonator electrodes.

Although not shown in FIG. 12, either or both of the frequency adjustment electrode and the external coupling adjustment electrode described in connection with the preceding embodiments may advantageously be included in this embodiment as well.

Next, an example of the configuration of a duplexer according to a sixth embodiment will be described with reference to FIG. 13.

Figure 13:
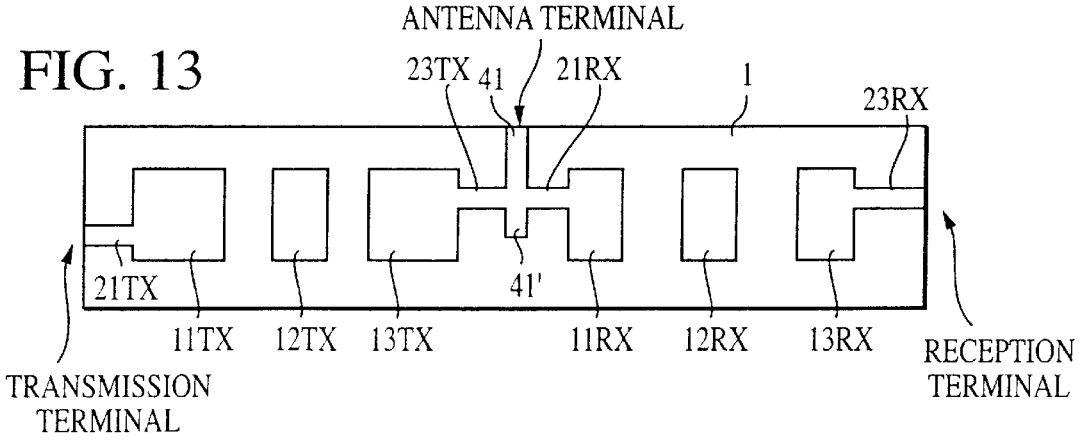
FIG. 13 is a plan view of the major part of a duplexer according to a sixth embodiment of the present invention.

In FIG. 13, reference numeral 1 designates a dielectric substrate. Six resonator electrodes 11TX, 12TX, 13TX, 11RX, 12RX, and 13RX are formed on the upper face of the substrate, respectively. The resonator electrodes 11TX, 12TX, and 13TX constitute a transmission filter, and the resonators 11RX, 12RX, and 13RX constitute a reception filter. A lead-out electrode 21TX is connected to the resonator electrode 11TX of the first stage in the transmission filter, and a lead-out electrode 23TX is connected to the resonator electrode 11RX of the last stage. Moreover, the lead-out electrode 21RX is connected to the resonator electrode 11RX of the first stage in the reception filter. A lead-out electrode 23RX is connected to the resonator electrode 13RX of the last stage. The lead-out electrodes 23TX and 21RX are connected to predetermined positions on an antenna lead-out electrode 41. A ground electrode is formed substantially on the whole of the under face of the dielectric substrate 1.

An impedance matching electrode 41' is extended from the connection point of the lead-out electrodes 23TX and 21RX connected to the antenna lead-out electrode 41, so that the antenna lead-out electrode 41 and the two lead-out electrodes 23TX and 21RX are impedance-matched.

By configuring as described above, the duplexer usable for example as an antenna sharing device is formed which includes the lead-out electrode 21TX as a transmission terminal, the lead-out electrode 23RX as a reception terminal, and the antenna lead-out electrode 41 as an antenna terminal.

The transmission filter comprising the resonator electrodes 11TX, 12TX, and 13TX shown in FIG. 13 has the same configuration as the filter of the first embodiment shown in FIG. 1. Accordingly, an attenuation pole is developed on the lower band side of the pass-band, that is, the transmission frequency band. Furthermore, the reception filter comprising the resonator electrodes 11RX, 12RX, and 13RX has the same configuration as the filter of the third embodiment shown in FIG. 5. Accordingly, an attenuation pole is developed on the higher band side of the transmission frequency band, that is, the pass-band. By using this duplexer in a communication system in which the reception frequency band is set to be adjacent to and on the lower side of the transmission frequency band, feeding a transmission signal to the reception circuit can be securely prevented, due to the attenuation characteristic caused by the respective attenuation poles of the transmission filter and the reception filter.

The duplexer may also be formed by use of two filters in which attenuation poles are developed on the lower band sides of the pass-bands, respectively. On the other hand, the duplexer may further be formed by use of two filters in which attenuation poles are developed on the higher band sides of the pass-bands, respectively.

Although not shown in FIG. 13, either or both of the frequency adjustment electrode and the external coupling adjustment electrode described in connection with the preceding embodiments may advantageously be included in this embodiment as well.

Figure 14:
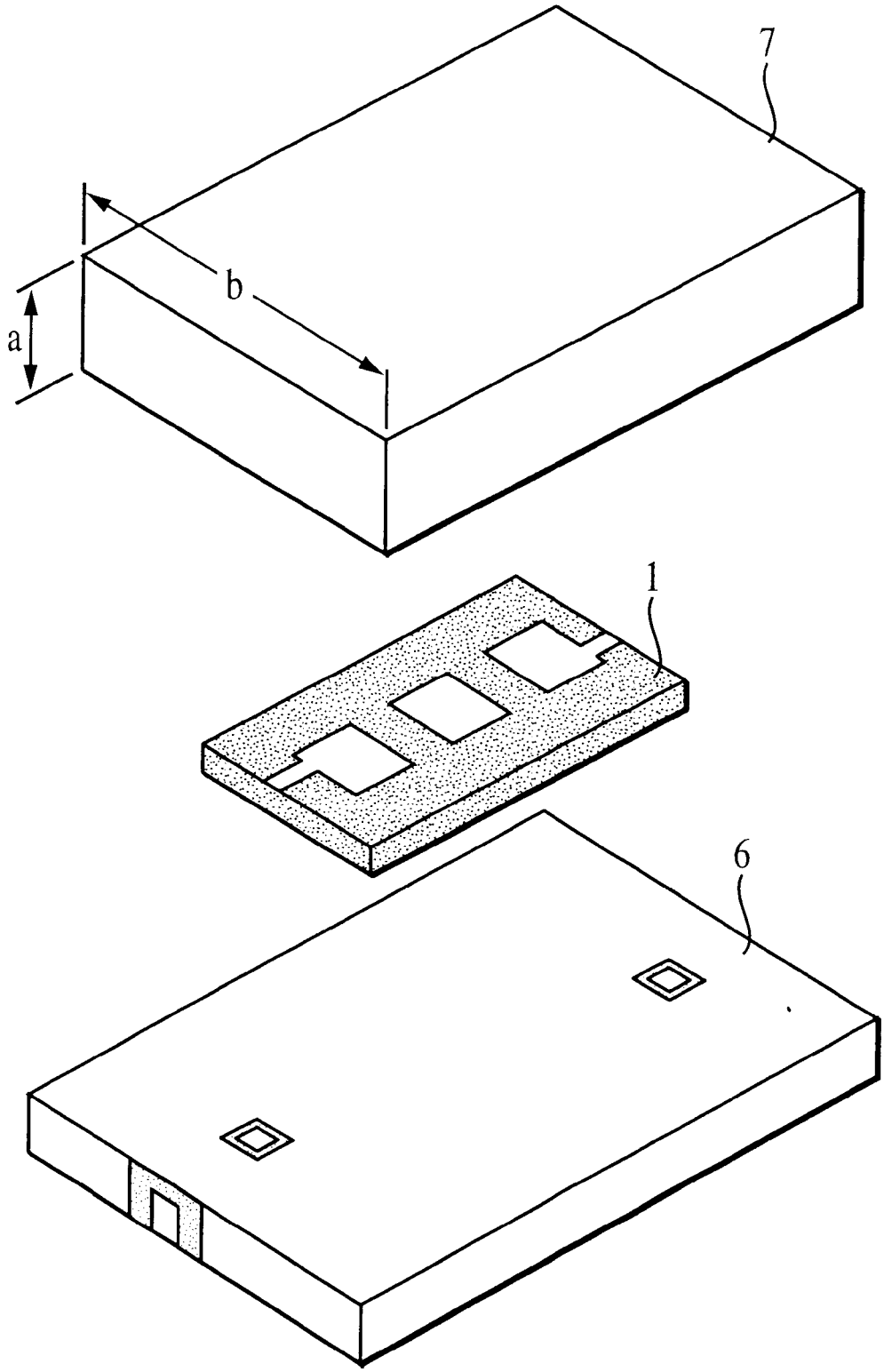
FIG. 14 is a perspective view showing the structure of a filter device according to a seventh embodiment of the present invention.

Next, the configuration of a filter device according to a seventh embodiment with reference to FIG. 14.

FIG. 14 is an exploded perspective view of the filter device. The filter device is formed by packaging a strip-line filter having a sheet-shape according to any one of the embodiments described previously. In FIG. 14, a base sheet 6 comprises a ceramic sheet having electrode films formed thereon. The base sheet 6 is provided with electrode pads for connecting the input-output terminals of lead-out electrodes in a strip-line filter 1, via-holes for connecting the electrode pads to electrodes on the under face of the base sheet 6, electrode patterns for leading out the electrodes on the under face to the end-faces of the sheet 6, and a ground electrode. The base sheet 6 and a metal cover 7 constitute a casing.

The filter device is formed by mounting the strip-line filter 1 onto the base sheet 6, connecting the lead-out electrodes of the filter 1 to the above-mentioned electrode pads by means of gold wires or gold ribbons, covering the base sheet with the metal cover 7, and electrically connecting the metal cover 7 to the ground electrode. The dimensions a and b of the metal cover 7 are determined so that a cut-off frequency in the space defined by the metal cover and the ground electrode of the base sheet 6 exerts no hazardous influence over the filter characteristic produced by the strip-line filter.

Although not shown in FIG. 14, either or both of the frequency adjustment electrode and the external coupling adjustment electrode described in connection with the preceding embodiments may advantageously be included in this embodiment as well.

The filter device shielded by the above-described structure can be surface-mounted, e.g., onto a circuit board in a communication device.

Next, the structure of a filter device according to an eighth embodiment will be described with reference to FIG. 15.

Figure 15:
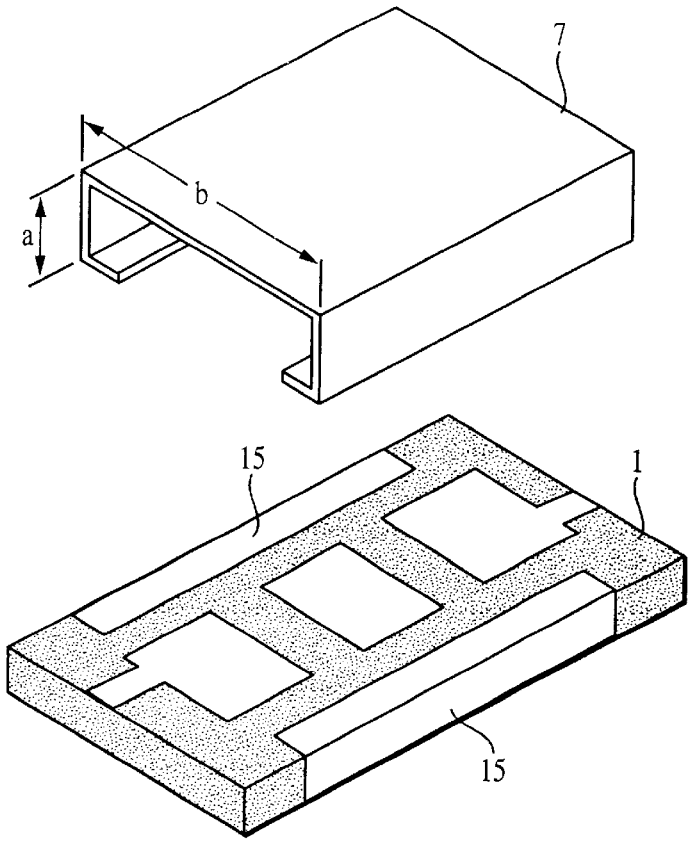
FIG. 15 is a perspective view showing the structure of a filter device according to an eighth embodiment of the present invention.

FIG. 15 is an exploded perspective view of the filter device. The filter device comprises a strip-line filter having a sheet-shape according to any one of the embodiments described above, and a metal cover. The substrate 1 of the strip-line filter has side electrodes 15 formed thereon. The filter device is formed by covering the substrate 1 with the metal cover 7, and simultaneously electrically connecting the metal cover 7 to the side electrodes 15. The dimensions a and b of the metal cover 7 are set so that the cut-off frequency in the space defined by the metal cover 1 and the substrate exerts no hazardous influence over the filter characteristic of the strip-line filter.

Although not shown in FIG. 15, either or both of the frequency adjustment electrode and the external coupling adjustment electrode described in connection with the preceding embodiments may advantageously be included in this embodiment as well.

This shielded filter device can also be surface-mounted, e.g., onto the circuit substrate of a communication device, due to the above-described structure.

Next, the structure of a filter device according to a ninth embodiment will be described with reference to FIG. 16.

Figure 16:
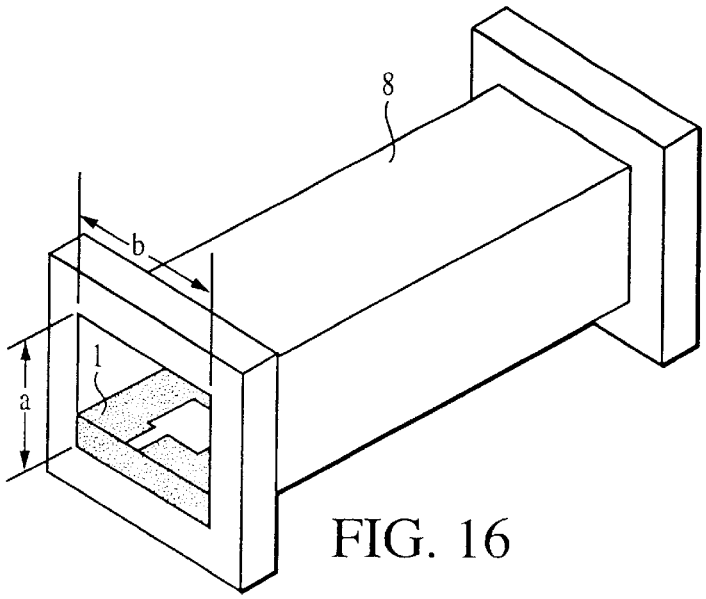
FIG. 16 is a perspective view showing the structure of a filter device according to a ninth embodiment of the present invention.

FIG. 16 is a perspective view of the filter device. The filter device comprises the strip-line filter having a sheet-shape according to any one of the embodiments described above, and a waveguide. As shown in FIG. 16, the filter device is formed by disposing the substrate 1 of the strip-line filter in a waveguide 8. The dimensions a and b of the waveguide 8 are set so that the cut-off frequency of this waveguide exerts no hazardous influence over the filter characteristic caused by the strip-line filter.

Although not shown in FIG. 16, either or both of the frequency adjustment electrode and the external coupling adjustment electrode described in connection with the preceding embodiments may advantageously be included in this embodiment as well.

The filter device with the above-described structure can be provided in a circuit, in which the waveguide acts as a transmission line.

Figure 17:
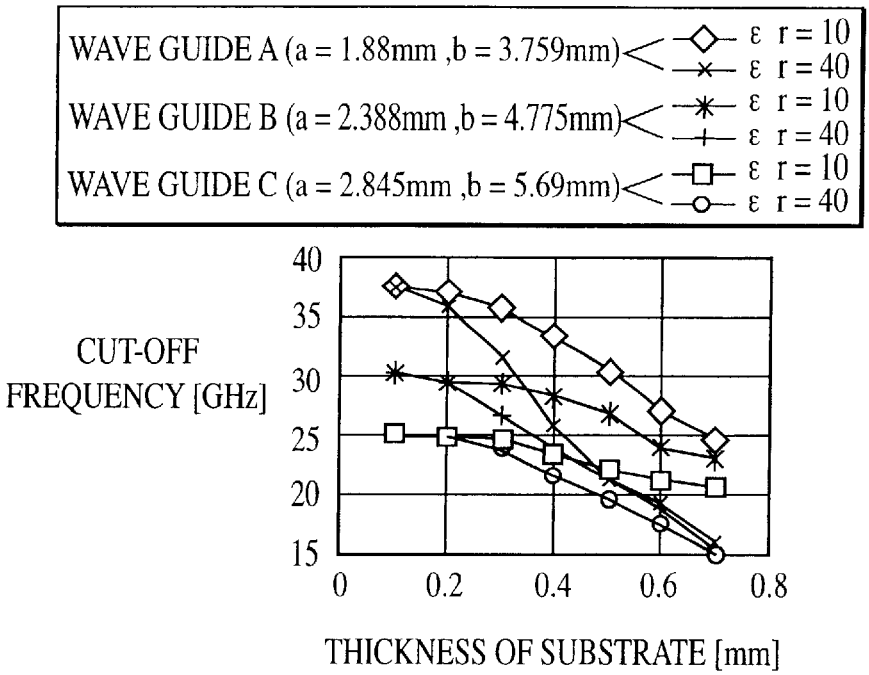
FIG. 17 illustrates the relation between the thickness of the substrate of the filter device and the cut-off frequency.

FIG. 17 shows the relation between the thickness of the substrate and the cut-off frequency of the waveguide, varying with the dimensions a and b of the waveguide and the dielectric constant of the strip-line filter substrate as parameters. As seen in the figure, the larger a and b become, the lower the cut-off frequency becomes. When the dielectric constant of the substrate or the thickness of the substrate increases, the cut-off frequency becomes lower. Based on these relations, the sizes of the waveguide can be determined, considering the dielectric constant ($\epsilon r$) of the substrate, the thickness, and the pass-band.

Figure 18:
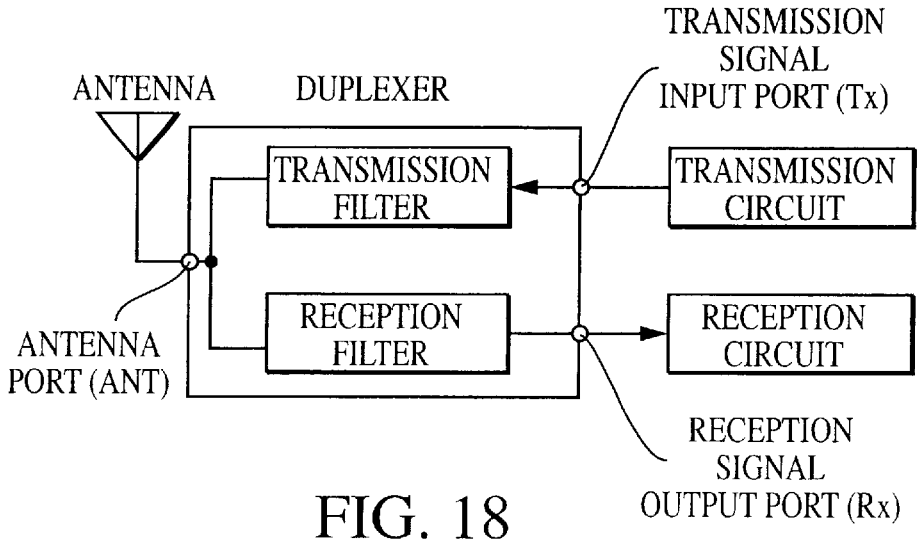
FIG. 18 is a block diagram showing the configuration of a communication device according to a tenth embodiment of the present invention.

Next, the configuration of a communication device according to a tenth embodiment is shown in the block diagram of FIG. 18.

In the figure, "a duplexer" comprises a transmission filter and a reception filter, and the communication device uses the duplexer having the structure shown in FIG. 13, comprising filters according to one or more of the disclosed embodiments. A transmission circuit is connected to the transmission signal input port of the duplexer, and a reception circuit is connected to the reception signal output port thereof, and moreover, an antenna is connected to the antenna port thereof. Furthermore, band-pass filters having the configurations shown in one or more of FIGS. 1 to 12 are incorporated in the transmission and reception circuits.

Although not shown in FIG. 18, either or both of the frequency adjustment electrode and the external coupling adjustment electrode described in connection with the preceding embodiments may advantageously be included in this embodiment as well.

As described above, a communication device having a small-size and which is light-weight as a whole can be provided by using the strip-line filter or the duplexer having a small-size and a predetermined characteristic.

In the embodiments, the resonator electrodes and the lead-out electrodes are formed on the surface of the dielectric substrate, and these electrodes function as microstrip-lines. On the other hand, the resonator electrodes and the lead-out electrode may be provided inside of a dielectric sheet, and ground electrodes may be formed on both of the sides of the dielectric sheet. Thereby, these electrodes function as strip-lines in a narrow sense.

According to the present invention, an attenuation pole is developed on the lower or higher band side of the pass-band. Therefore, the attenuation characteristic becomes steep in the range between the lower or higher band side of the pass-band and the attenuation band. Furthermore, attenuation poles are not produced on both sides of the pass-band. Accordingly, the insertion loss in the pass-band is not increased, and moreover, the band does not become narrow.

Furthermore, the resonance frequency and attenuation pole frequency of each resonator electrode are determined by the patterns of the resonator electrodes and the lead-out electrodes formed on the substrate. Therefore, if frequency variations are generated due to pattern formation inaccuracies, the attenuation frequency is changed correspondingly, in response to the departure in resonance frequency of the respective resonators. This prevents the overall balance of the filter characteristic from being disturbed. Thus, a stable filter characteristic can be simply obtained.

Moreover, by leading out the lead-out electrodes substantially to the centers of the ends of the substrate, connections between the substrate having the filter formed thereon and electrodes provided on a circuit board or package for mounting the substrate are performed more efficiently.

Furthermore, in the duplexer according to the present invention, two strip-line filters are provided. Therefore, a signal is transmitted through two frequency bands, under the condition of a low insertion loss, and simultaneously, signals in an unnecessary frequency band are suppressed. Accordingly, a circuit having an excellent filter characteristic can be formed, though it is small in size.

Moreover, in the transmission filter, a high attenuation amount can be provided in a reception frequency band, and in the reception filter, a high attenuation amount can be provided in a transmission frequency band. Accordingly, in the communication system in which the transmission frequency band and the reception frequency band are near to each other, one of the bands can be prevented from affecting the other band.

Furthermore, according to the present invention, the strip-line filter or duplexer can be incorporated in a device without the filter characteristic being deteriorated, and unnecessary radiation and coupling to an external circuit being eliminated.

Moreover, according to the present invention, the communication device having a small-size and light-weight as a whole can be provided, since it uses the filter or duplexer having a small-size and a predetermined characteristic.

Also, according to the present invention, the filter or duplexer having a predetermined center frequency can be easily manufactured.

Furthermore, according to the present invention, the filter or duplexer having a predetermined external coupling can be easily manufactured.

Although the present invention has been described in relation to particular embodiments thereof, many other variations and modifications and other uses will become apparent to those skilled in the art. Therefore, the present invention is not limited by the specific disclosure herein.

What is claimed is:

1. A strip-line filter comprising plural resonator electrodes each constituting half-wave resonators arranged in one direction on or inside of a substrate, and lead-out electrodes connected to the resonator electrodes of the first and last stages, at least one of the resonator electrodes of the first and last stages having a ratio (W/L) of an electrode width W to an electrode length L of substantially $0.5<W/L<0.95$, in which the electrode length L is an electrode length of the resonator electrode measured perpendicular to the direction in which the resonator electrodes are arranged, and the electrode width W is an electrode width of said resonator electrode measured parallel to said arrangement direction, the lead-out electrodes being connected to the resonator electrodes of the first and last stages on the same side of the center axis, which is a straight line axis passing through the center positions along said length direction of the resonator electrodes of the first and last stages.

2. A strip-line filter according to claim 1, wherein the lead-out electrodes each are led-out substantially onto said center axis at the ends thereof, and function as input-output terminals.

3. A strip-line filter according to claim 1, wherein an external coupling electrode is formed on at least one of the lead-out electrodes so as to protrude from said arrangement direction.

4. A strip-line filter according to claim 1, wherein the resonator electrodes each have a rectangular shape.

5. A duplexer comprising two strip-line filters, one said filter being a strip-line filter according to claim 1, a first lead-out electrode of one filter being connected to a receiving terminal, a first lead-out electrode of the other filter being connected to a transmitting terminal, and second lead-out electrodes of both filters being connected in common to an antenna terminal.

6. A strip-line filter according to claim 1, wherein said lead-out electrodes are conductively connected directly to the resonator electrodes of the first and last stages, respectively.

7. A strip-line filter according to claim 6, wherein said lead-out electrodes are spaced away from said center axis.

8. A strip-line filter according to claim 1, wherein said lead-out electrodes are spaced away from said center axis.

9. A strip-line filter according to claim 1, wherein said ratio of W/L produces an attenuation pole at a high side of an operating frequency band of said strip-line filter.

10. A strip-line filter comprising plural resonator electrodes each constituting half-wave resonators arranged in one direction on or inside of a substrate, and lead-out electrodes connected to the resonator electrodes of the first and last stages, at least one of the resonator electrodes of the first and last stages having a ratio (W/L) of an electrode width W to an electrode length L of substantially $0.1<W/L<0.95$, in which the electrode length L is an electrode length of the resonator electrode measured perpendicular to the direction in which the resonator electrodes are arranged, and the electrode width W is an electrode width of said resonator electrode measured parallel to said arrangement direction, the lead-out electrodes being connected to the resonator electrodes of the first and last stages on the same side of the center axis, which is a straight line axis passing through the center positions along said length direction of the resonator electrodes of the first and last stages; and wherein a frequency adjustment electrode is formed on at least one of the plural resonator electrodes so as to protrude from said arrangement direction.

11. A strip-line filter according to claim 10, further comprising an external coupling electrode which is formed on at least one of the lead-out electrodes so as to protrude from said arrangement direction.

12. A strip-line filter according to claim 11, wherein said external coupling electrode protrudes perpendicularly to said arrangement direction.

13. A strip-line filter according to claim 12, wherein said external coupling electrode has a width smaller than that of the lead-out electrode.

14. A strip-line filter according to claim 10, wherein said frequency adjustment electrode protrudes perpendicularly to said arrangement direction.

15. A strip-line filter according to claim 14, wherein said frequency adjustment electrode has a width smaller than said electrode width W.

16. A strip-line filter comprising plural resonator electrodes each constituting half-wave resonators arranged in one direction on or inside of a substrate, and lead-out electrodes connected to the resonator electrodes of the first and last stages, at least one of the resonator electrodes of the first and last stages having a ratio (W/L) of an electrode width W to an electrode length L of substantially $0.1<W/L<0.95$, in which the electrode length L is an electrode length of the resonator electrode measured perpendicular to the direction in which the resonator electrodes are arranged, and the electrode width W is an electrode width of said resonator electrode measured parallel to said arrangement direction, the lead-out electrodes being connected to the resonator electrodes of the first and last stages on the same side of the center axis, which is a straight line axis passing through the center positions alone said length direction of the resonator electrodes of the first and last stages;

wherein an external coupling electrode is formed on at least one of the lead-out electrodes so as to protrude from said arrangement direction, and wherein said external coupling electrode protrudes perpendicularly to said arrangement direction.

17. A strip-line filter according to claim 16, wherein said external coupling electrode has a width smaller than that of the lead-out electrode.

18. A duplexer comprising two strip-line filters, a first lead-out electrode of one filter being connected to a receiving terminal, a first lead-out electrode of the other filter being connected to a transmitting terminal, and second lead-out electrodes of both filters being connected in common to an antenna terminal;

wherein one of said two strip-line filters is a strip-line filter comprising plural resonator electrodes each constituting half-wave resonators arranged in one direction on or inside of a substrate, and lead-out electrodes connected to the resonator electrodes of the first and last stages, at least one of the resonator electrodes of the first and last stages having a ratio (W/L) of an electrode width W to an electrode length L of substantially $1.05<W/L<1.95$, in which the electrode length L is an electrode length of the resonator electrode measured perpendicular to the direction in which the resonator electrodes are arranged, and the electrode width W is an electrode width of said resonator electrode measured parallel to said arrangement direction, the lead-out electrodes being connected to the resonator electrodes of the first and last stages on the opposite sides of the center axis, which is a straight line axis passing through the center positions along said length direction of the resonator electrodes of the first and last stages; and wherein the other strip-line filter is a strip-line filter comprising plural resonator electrodes each constituting half-wave resonators arranged in one direction on or inside of a substrate, and lead-out electrodes connected to the resonator electrodes of the first and last stages, at least one of the resonator electrodes of the first and last stages having a ratio (W/L) of an electrode width W to an electrode length L of substantially $0.1<W/L<0.95$, in which the electrode length L is an electrode length of the resonator electrode measured perpendicular to the direction in which the resonator electrodes are arranged, and the electrode width W is an electrode width of said resonator electrode measured parallel to said arrangement direction, the lead-out electrodes being connected to the resonator electrodes of the first and last stages on the same side of the center axis, which is a straight line axis passing through the center positions along said length direction of the resonator electrodes of the first and last stages.

19. A method of adjusting a characteristic of a strip-line filter comprising plural resonator electrodes each constituting half-wave resonators arranged in one direction on or inside of a substrate, and lead-out electrodes connected to the resonator electrodes of the first and last stages, comprising the steps of:

forming a frequency-adjustment electrode on at least one of the plural resonator electrodes so as to protrude from said arrangement direction; and removing a predetermined amount of the frequency adjustment electrode so as to adjust the center frequency of the filter.

20. A method of adjusting a characteristic of a strip-line filter comprising plural resonator electrodes each constituting half-wave resonators arranged in one direction on or inside of a substrate, and lead-out electrodes connected to the resonator electrodes of the first and last stages, comprising the steps of:

forming an external coupling electrode on at least one of the lead-out electrodes so as to protrude from said arrangement direction; and removing a predetermined amount of the external coupling adjustment electrode so as to adjust external coupling of the filter.

21. A method according to claim 20, further comprising the steps of:

forming a frequency-adjustment electrode on at least one of the plural resonator electrodes so as to protrude from said arrangement direction; and removing a predetermined amount of the frequency adjustment electrode so as to adjust the center frequency of the filter.

22. A strip-line filter comprising plural resonator electrodes each constituting half-wave resonators arranged in one direction on or inside of a substrate, and lead-out electrodes connected to the resonator electrodes of the first and last stages, at least one of the resonator electrodes of the first and last stages having a ratio (W/L) of an electrode width W to an electrode length L of substantially $0.1<W/L<0.95$, in which the electrode length L is an electrode length of the resonator electrode measured perpendicular to the direction in which the resonator electrodes are arranged, and the electrode width W is an electrode width of said resonator electrode measured parallel to said arrangement direction, the lead-out electrodes being connected to the resonator electrodes of the first and last stages on the same side of the center axis, which is a straight line axis passing through the center positions along said length direction of the resonator electrodes of the first and last stages; and wherein the resonator electrodes each have a rectangular shape.

23. A strip-line filter according to claim 22, wherein said ratio of W/L produces an attenuation pole at a high side of an operating frequency band of said strip-line filter.

* * * * *